United States Patent [19]

Magnuson

[11] 3,972,265

[45] Aug. 3, 1976

[54] STROKE CONTROL DEVICE

[75] Inventor: Ruel D. Magnuson, Lincoln, Nebr.

[73] Assignee: Bruning Company, Lincoln, Nebr.

[22] Filed: Dec. 9, 1974

[21] Appl. No.: 530,756

Related U.S. Application Data

[63] Continuation of Ser. No. 384,982, Aug. 2, 1973, abandoned.

[52] U.S. Cl. ..... 91/404; 91/468

[51] Int. Cl.² ..... F15B 13/042

[58] Field of Search ..... 91/404, 405, 406

[56] References Cited

UNITED STATES PATENTS

| | | | |
|---|---|---|---|
| 1,544,751 | 7/1925 | Haynes et al. | 91/404 |
| 2,699,150 | 1/1955 | Ziskal | 91/405 |
| 2,858,803 | 11/1958 | Ethington et al. | 91/406 |
| 2,939,427 | 6/1960 | Peros | 91/404 |
| R23,537 | 8/1952 | Fletcher | 91/405 |

*Primary Examiner*—Paul E. Maslousky

*Attorney, Agent, or Firm*—Wegner, Stellman, McCord, Wiles & Wood

[57] ABSTRACT

A stroke control mechanism for a hydraulic actuator having a piston and cylinder device including a blocking valve for selectively blocking fluid flow from one side of the actuator, the blocking valve consisting of a spring biased check valve mounted on one end of a valve stem and actuable by a control bar on the piston rod at the end of the stroke of the piston, the spring biased check valve being constructed to be opened by fluid pressure flowing to the extending side of the piston without movement of the valve stem so that creepage of the piston during its retracting movement resulting in contact between the valve stem and the actuating member will not prevent reversal of the piston.

1 Claim, 5 Drawing Figures

Fig. 1.
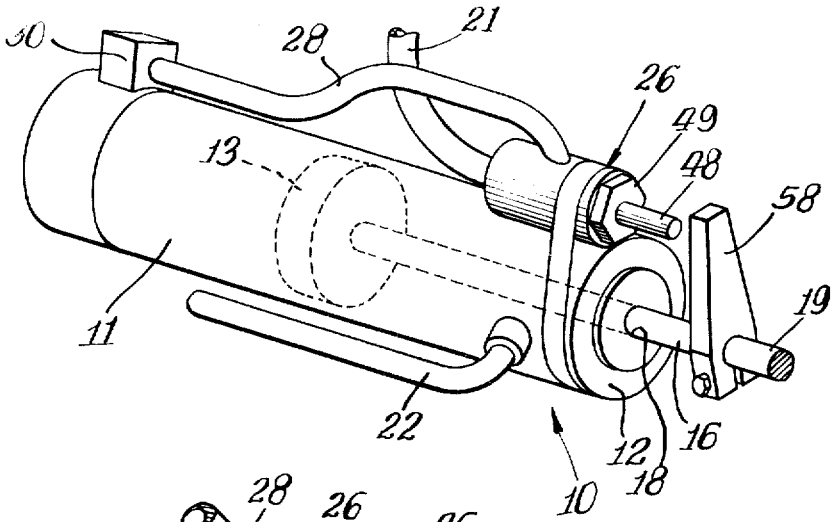
Fig. 2.
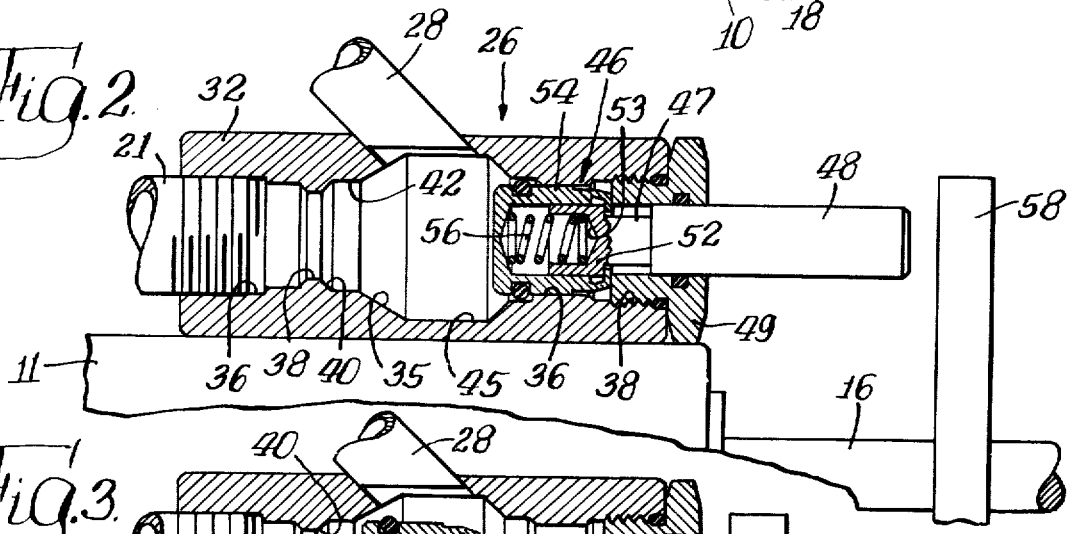
Fig. 3.
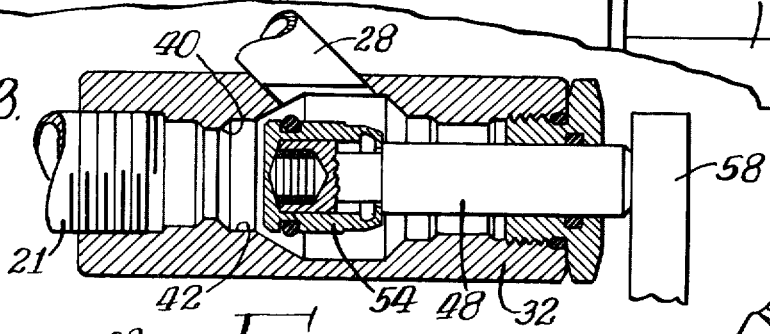
Fig. 5.
Fig. 4.
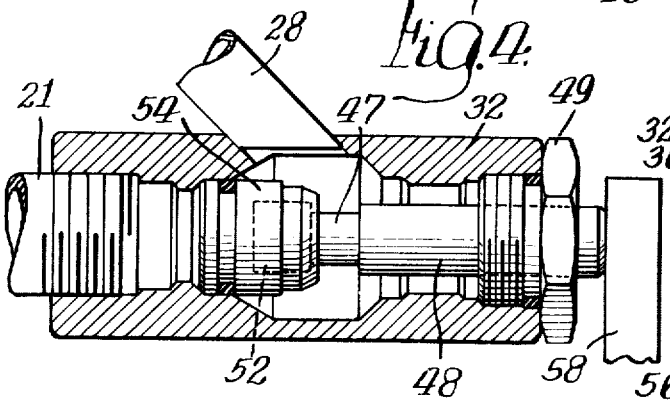
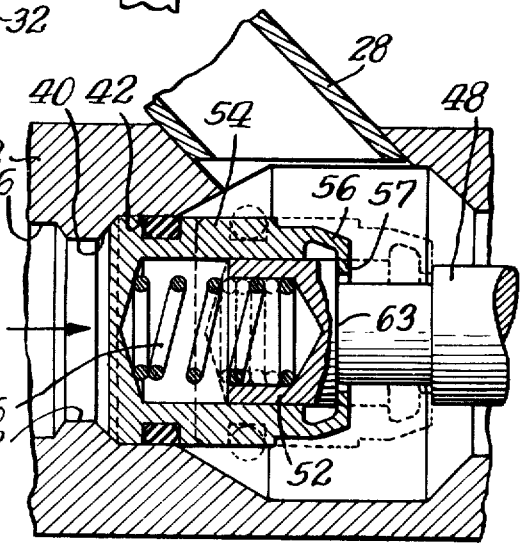

STROKE CONTROL DEVICE

This is a continuation of application Ser. No. 384,982 filed Aug. 2, 1973 now abandoned.

BACKGROUND OF THE PRESENT INVENTION

It is conventional in the prior art to provide locking valves that prevent exhaust flow from a hydraulic actuator and arrest the associated piston at the end of its stroke. The deficiency in these hydraulic stroke control valves is that leakage passed the main piston permits the piston to creep somewhat and tightly drive the exhaust control valve into its valve seat and thereby prevent flow from the pump to the extending side of the hydraulic actuator.

More particularly, the present invention relates to a hydraulic actuator having a piston and piston rod slidable therein with fluid interconnections to a directional control valve for driving the piston in opposite directions.

An exhaust flow blocking valve is provided for preventing exhaust flow from one side of the hydraulic actuator thereby arresting the piston at the end of its retracting stroke.

An actuating element is provided on the main piston rod for driving this valve to its closed position. As the piston nears its end of stroke the actuating element drives the valve towards its closed position and as it nears its closed position, fluid flow, exhausting from the cylinder, snaps the valve to its fully closed position, leaving a gap between the valve stem and the actuating element, which gap permits the valve to open upon reversal of the directional control valve. However, it has been found in many cases that fluid leakage past the main piston results in creepage of the piston and rod so that the actuating element engages the valve stem and eliminates any gap therebetween. Thus upon reversal of the directional control valve, the blocking valve is unable to open preventing reversal of the actuator and frequently damaging the actuating element.

It is a primary object of the present invention to overcome this prior art problem.

SUMMARY OF THE PRESENT INVENTION

In accordance with the present invention, an exhaust flow control valve is provided for a hydraulic actuator that eliminates the problem of actuator creepage after the exhaust flow control valve has closed.

To accomplish this objective, the exhaust flow control valve is provided with a check valve on the end thereof movable with respect to the valve stem and urged away from the valve stem by a spring. The effect of this is that when the actuator member connected to the piston begins closing the exhaust flow control valve, the valve will snap to its closed position in a manner similar to the prior art leaving a gap between the valve stem and the actuator member. However, also in accordance with the prior art, there may be some piston creepage which reduces or possibly even eliminates this gap.

However, because the end of the valve, or more particularly the check valve, has a lost motion connection with respect to the valve stem, a reversal in pressure to the hydraulic actuator will open the check valve without movement of the valve stem permitting the actuator to reverse its cycle in normal fashion.

BRIEF DESCRIPTION OF THE DRAWINGS

FIG. 1 is a perspective view of an actuator having a stroke control mechanism according to the present invention.

FIG. 2 is a fragmentary cross section showing the stroke control valve in its fully open position.

FIG. 3 is a fragmentary section of the stroke control valve in its open position with the piston beginning to extend.

FIG. 4 is a fragmentary section of the stroke control valve in its fully closed position, and FIG. 5 is an enlarged fragmentary section of the stroke control valve in its closed position.

DETAILED DESCRIPTION OF THE PREFERRED EMBODIMENT

Referring to the drawings and particularly FIG. 1, the hydraulic actuator 10 is illustrated consisting of a cylinder 11 having end plates 12 with a piston 13 slidable therein. Fixed to the piston 13 is a main piston rod 16 projecting through end cap 12 at 18 and having a projecting portion 19 adapted to drive a load.

For delivering fluid to the cylinder 11 on opposite sides of the piston 13 to provide extending and retracting motion of piston 13, conduits 21 and 22 are provided.

Fluid flow to the left side of the piston 13 is through conduit 21, stroke control mechanism 26, conduit 28 and port block 30 on the left side of cylinder 11.

The stroke control mechanism 26 is a valve that blocks flow exhausting through conduit 28 toward conduit 21 and prevents retracting movement of the piston 13 and hence defines the left end of stroke of piston 13.

Toward this end as seen more clearly in FIG. 2, the stroke control mechanism 26 consists of a cylindrical housing member 32 strapped to one end of the cylinder 11.

The cylindrical member 32 has a stepped bore 35 with its left end 36 receiving the end of conduit 21 leading to the directional control valve. After a reduced portion 38 there is provided a valve seat 40 and an adjacent cylindrical portion 42.

The valve bore has an enlarged portion 45 communicating with a right hand reduced portion 36 in turn communicating with a threaded portion 38 on the right end of the valve housing 32.

Slidable within the valve bore is an exhaust flow control valve 46 that selectively blocks flow from the cylinder line 28 toward the directional control valve connected passage 21 to arrest movement of the piston 13 in its retracting direction. The exhaust flow control valve 46 includes a valve stem 48 slidable in an end cap 49 threaded in the right end of the valve housing 32.

The valve stem 48 has a reduced portion 47 and an end portion 52 having a counterbore 53 therein. Slidable on the end portion 49 is a check valve member 54 spring biased to the left by a spring 56 seated within the counterbore 53.

The valve member 54 is generally cylindrical and has a conical rear flange 56 as shown in FIG. 5 with an annular connecting flange 57 that serves to limit the leftward movement of the valve piston 54 on the valve stem 48.

In operation, as the piston rod 16 moves to the left an actuating member 58 carried by the rod 16 engages the valve stem 48 and moves the entire valve 46 toward the left. As the valve assembly nears the position shown in FIG. 4 fluid exhausting from passage or conduit 28 into bore 35 to conduit 21 snaps the valve closed so that a gap results between the actuating member 58 and the end of the valve stem 48. This gap, however, may be closed by continued creepage of the piston 13 because of cross-over leakage.

The normal closed position of the valve 46 is illustrated in FIG. 5 with the valve head 54 biased away from the stem 48, with flange 57 engaging shoulder 65 and with the valve head 54 engaging valve seat 40 preventing flow from the conduit 28 to the conduit 21 and arresting the retracting movement of the piston 13.

To initiate the extension of the piston 13 within cylinder 11, the directional control valve associated with conduits 21 and 22 is reversed, porting fluid to conduit 21 and exhausting fluid from conduit 22. This results in a retraction of the piston head 54 with respect to the valve stem 48 as shown in FIG. 3 permitting flow from conduit 21 to conduit 28 initiating the extension movement of the piston 13. Thus, even if the actuating member 54 is in engagement with the stem 48 while the valve is in its closed position, the piston 13 may nevertheless be extended by pressurizing conduit 21 and sliding valve head 54 with respect to the valve stem 48. After the valve head 54 permits initial flow from conduit 21 to conduit 28, the piston 13 will begin extending and actuator 58 will move away from valve stem 48 permitting the valve stem and the entire valve 46 to move to the position shown in FIG. 2.

Movement of the piston 13 will continue to the right until reversed by the directional control valve (not shown) connected to conduits 21 and 22.

I claim:

1. Stroke control means for controlling the stroke of a hydraulic actuator having a piston movably carried in a closed cylinder provided with spaced first and second ports for providing a hydraulic fluid pressure differential across the piston for moving the piston reciprocally in the cylinder, a piston rod extending from said piston to exteriorly of said cylinder, and duct means including first, second and third ducts, said first and second ducts being connected one each to said first and second ports, said stroke control means comprising: an operator movable in correspondence with movement of said actuator piston; and a control device controlled by said operator defined by wall means defining a flow chamber having a third port defining a valve seat and adapted to be selectively connected through said first duct to a source of pressurized hydraulic fluid or exhaust, said wall means further defining an inwardly narrowing flow guiding surface outwardly coaxially adjacent said third port, and a fourth port spaced from said third port outwardly of said flow guiding surface, said second duct providing fluid flow connected between said fourth port and said cylinder second port, a valve stem extending through said wall means having an inner end provided with an outwardly facing shoulder and an inwardly facing shoulder spaced outwardly of said outwardly facing shoulder within said flow chamber, and an outer end disposed to be engaged by said operator, a cup-shaped valve head coaxially telescopically carried on said valve stem inner end to have preselected limited relative movement axially thereof, said valve stem being urged inwardly by movement of said operator corresponding to movement of said piston in a first direction toward one end of the stroke thereof in said cylinder caused by delivery of pressurized hydraulic fluid to said first port, said valve head having a flange engaged by said inwardly facing valve stem shoulder for causing said valve head to be moved to a preselected position spaced adjacent said third port valve seat as an incident of said piston being moved in said first direction to a preselected limit position in said cylinder, spring means disposed coaxially within said cup-shaped valve head for biasing the valve head inwardly relative to said valve stem, said second duct, during movement of the piston to said limit position, conducting hydraulic fluid from said second cylinder port to said fourth port for flow through said flow chamber past said valve head and through said third port and first duct to exhaust, said valve head being snapped into seated engagement with said valve seat to close said third port by the hydraulic fluid flowing inwardly along said flow guiding surface to said third port when said piston reaches said limit position, said valve stem being urged outwardly by said spring means when said valve head is snapped into seated engagement with said valve seat with said flange engaging said outwardly facing shoulder upon delivery of pressurized hydraulic fluid through said chamber from said third port and from said chamber through said fourth port to said cylinder second port notwithstanding inward movement of said valve stem inner shoulder away from said flange resulting from creepage of the piston beyond said limit position subsequent to the closing of said third port by the snapped movement of the valve head.

* * * * *